US005732720A

United States Patent [19]

Sears

[11] Patent Number: 5,732,720

[45] Date of Patent: Mar. 31, 1998

[54] ORNAMENTAL DEVICE AND HAIR FASTENER

[76] Inventor: Betsy G. Sears, Betsy Sears Enterprises, 876 Lexington St., Hemet, Calif. 92545

[21] Appl. No.: 665,383

[22] Filed: Jun. 18, 1996

[51] Int. Cl.[6] ..... A45D 24/04

[52] U.S. Cl. ..... 132/128; 132/273; 132/275; 2/174

[58] Field of Search ..... 132/128, 126, 132/275, 273; 2/174, 171; D28/39, 32, 41

[56] References Cited

U.S. PATENT DOCUMENTS

| | | | |
|---|---|---|---|
| D. 110,922 | 8/1938 | Gagnon . | |
| D. 128,190 | 7/1941 | Karlen . | |
| D. 260,693 | 9/1981 | Payne et al. . | |
| D. 261,181 | 10/1981 | Sands . | |
| D. 316,161 | 4/1991 | Kuglen . | |
| D. 323,907 | 2/1992 | Andrade . | |
| D. 334,793 | 4/1993 | Richardson . | |
| 2,386,682 | 10/1945 | Heineman . | |
| 5,456,274 | 10/1995 | Selbee et al. | 2/174 X |

FOREIGN PATENT DOCUMENTS

| | | | |
|---|---|---|---|
| 869103 | 1/1942 | France | 132/128 |
| 25633 | 9/1902 | Switzerland | 132/273 |

*Primary Examiner*—Jeffrey A. Smith
*Attorney, Agent, or Firm*—Richard C. Litman

[57] ABSTRACT

A hair fastener intended to be used with retaining combs to retain hair in a style as desired by a wearer. The hair fastener includes a fabric tube, a pocket disposed at each end of the tube, and an elastic band running along each edge of the tube. The wearer may easily insert into and remove from each of the pockets a retaining comb. The pockets in combination with retaining combs and the elastic bands of the hair fastener permit the wearer to securely and attractively maintain the desired hair style without breaking or damaging the hair.

18 Claims, 4 Drawing Sheets

ORNAMENTAL DEVICE AND HAIR FASTENER

BACKGROUND OF THE INVENTION

1. Field of the Invention

The present invention relates to ornamental and functional clothing devices, and particularly to hairbands for use with retaining combs to secure hair in a style as desired by the wearer.

2. Description of the Prior Art

A hairband usually has both functional and ornamental characteristics. Functionally, a wearer manipulates their hair into a desired style and adorns a hairband in order to keep the hair in place. Most hairbands also have an ornamental appearance which normally aids the wearer in achieving the finished hair style. Oftentimes, however, the ornamental aspect of a hairband is undermined by the inability of the wearer to maintain the desired look due to an inability of the hairband to securely hold the hair. As such, many attempts have been made to invent a hairband that achieves the desired appearance without compromising functionality.

The prior art discloses a variety of structural elements used in the construction of a hairband designed to graspingly hold the hair of the wearer once it has been styled. The structural elements typically disclosed involve some type of metal barrette, retaining comb, and/or elastic band. Metal barrettes have a tendency to damage the hair of the wearer. A wearer with short hair is often unable to effectively use a retaining comb because of the quantity of hair needed to be inserted through the retaining comb for it to function properly. Furthermore, the prior art does not disclose a retaining comb which can be separated from the body of the hairband for convenient washing of the hairband in order to maintain the ornamental characteristic of the article of clothing.

Some examples of the prior art disclosing hairbands which have retaining combs include U.S. Pat. Nos. Des. 110,922, issued Aug. 16, 1938, to L. J. Gagnon; Des. 260,693, issued Sep. 8, 1981, to Payne et al.; and Des. 261,181, issued Oct. 6, 1981, to Gloris J. Sands. Gagnon, Payne et al., and Sands appear to disclose a single retaining comb centrally integrated into or affixed to the body of the hairband. In particular, Gagnon discloses integrating one end of a retaining comb into a flower hair ornament. Payne et al. discloses a retaining comb having a spring or clip affixed to a butterfly hair ornament. Sands discloses affixing a retaining comb to seashells and artificial flowers.

Other examples of the prior art disclosing hairbands which have retaining combs include U.S. Pat. Nos. Des. 128,190, issued Jul. 8, 1941, to L. Karlen; 2,386,682, issued Oct. 9, 1945, to F. Heineman; Des. 316,161, issued Apr. 9, 1991, to Francesca B. Kuglen; and Des. 323,907, issued Feb. 11, 1992, to Diane L. Andrade. Karlen and Heineman disclose headwear having a retaining comb integrated into each end of the headwear. Kuglen discloses a combination hair ornament and retaining combs having three separate tubes sewn at each end to a retaining comb having clasps which appear to aid in holding the series of tubes together. Andrade appears to disclose a plurality of combs connected together at a series of hinges affixed to a hair fastener wherein the combs run the entire length of the fastener.

An example of the prior art which discloses hairbands having retaining combs in addition to elastic bands includes U.S. Pat. No. Des. 334,793, issued Apr. 13, 1993, to Melody F. Richardson. Richardson discloses a combined elastic hair ornament and retaining combs wherein the combs appear to be integrated into the ends of a donut-shaped hair ornament.

None of the above inventions and patents, taken either singularly or in combination, is seen to describe the instant invention as claimed. Thus a hair fastener solving the aforementioned problems is desired.

SUMMARY OF THE INVENTION

The hair fastener according to the present invention is intended to be used with retaining combs to retain hair in a style as desired by a wearer. The hair fastener includes a fabric tube, a pocket disposed at each end of the tube, and an elastic band running along each edge of the tube.

The preferred embodiment includes having each of the pockets defined by a fold made approximately three-fourths of an inch from one end of the tube. When the combs are inserted into the pockets, each pocket should conceal approximately half of the retaining comb. As such, the wearer need not have as much hair placed through the retaining comb for the hairband to function properly when compared to the amount of hair a fully exposed retaining comb requires. Each of the folds are secured to the backside of the tube by a pair of top and bottom bar tacks such that the retaining combs may be easily removed from and inserted into the pockets. This is especially convenient for washing the fabric tube in order to maintain its ornamental appearance. The combined action of the pockets and the elastic bands securely lock the retaining combs into place without breaking or damaging the hair.

Accordingly, it is a principal object of the invention to provide an ornamental hairband with superior gripping properties.

It is another object of the invention to provide a hairband to be used with retaining combs which may be easily inserted into and removed from the body of the hairband.

It is a further object of the invention to provide a hairband which permits the wearer to securely and attractively maintain the desired hair style without breaking or damaging the hair.

Still another object of the invention is to provide a hairband which can be washed by the wearer whenever convenient.

It is an object of the invention to provide improved elements and arrangements thereof in a hairband for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
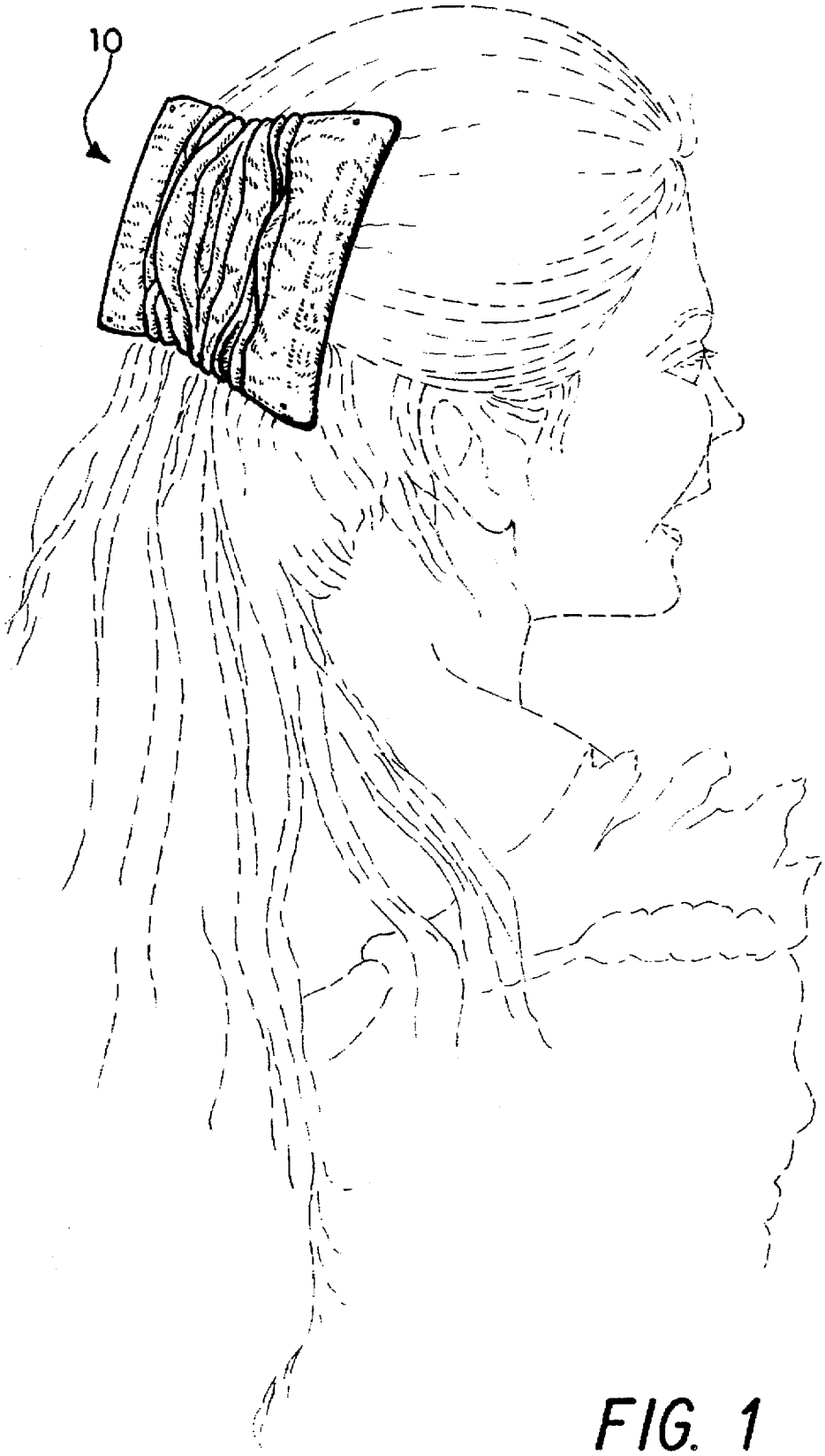
FIG. 1 is an environmental, perspective view of a hair fastener embodying the present invention.
Figure 2:
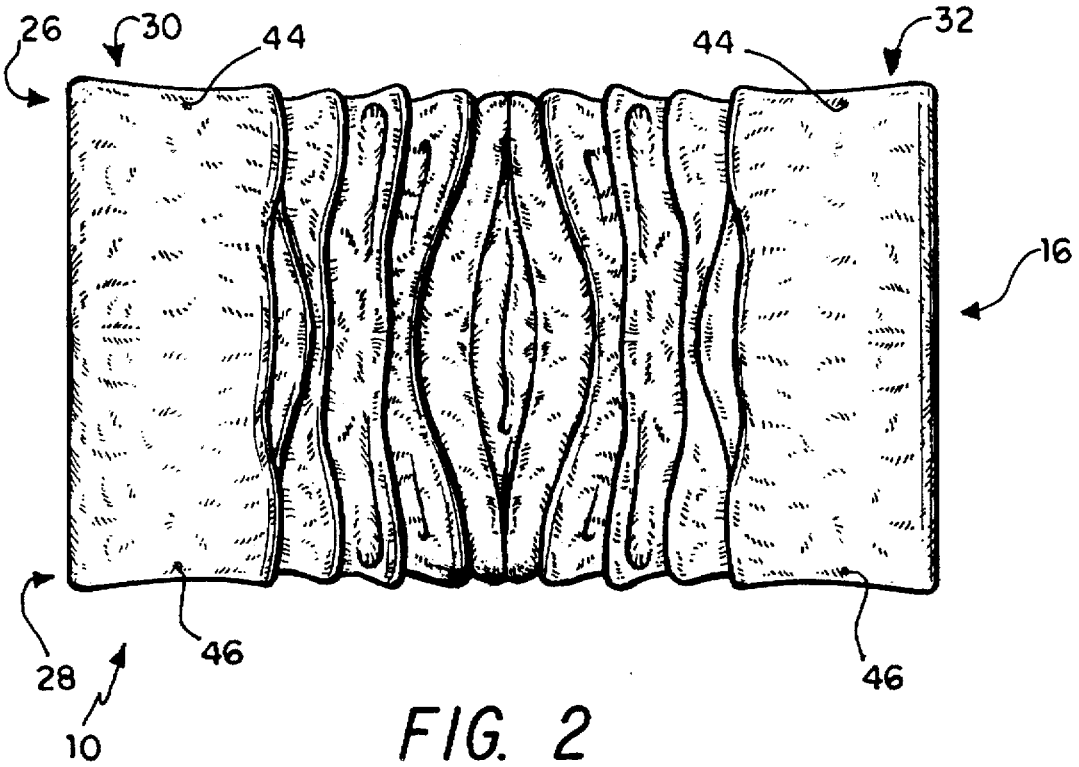
FIG. 2 is a front elevational view of a hair fastener embodying the present invention as seen in FIG. 1.
Figure 3:
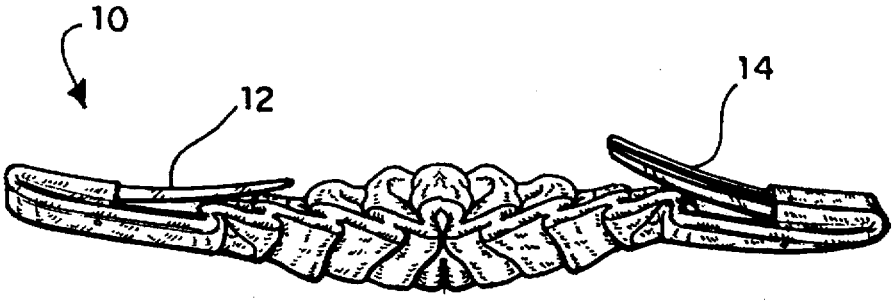
FIG. 3 is a top plan view of the hair fastener as seen in FIG. 1 showing each pocket containing a retaining comb.
Figure 4:
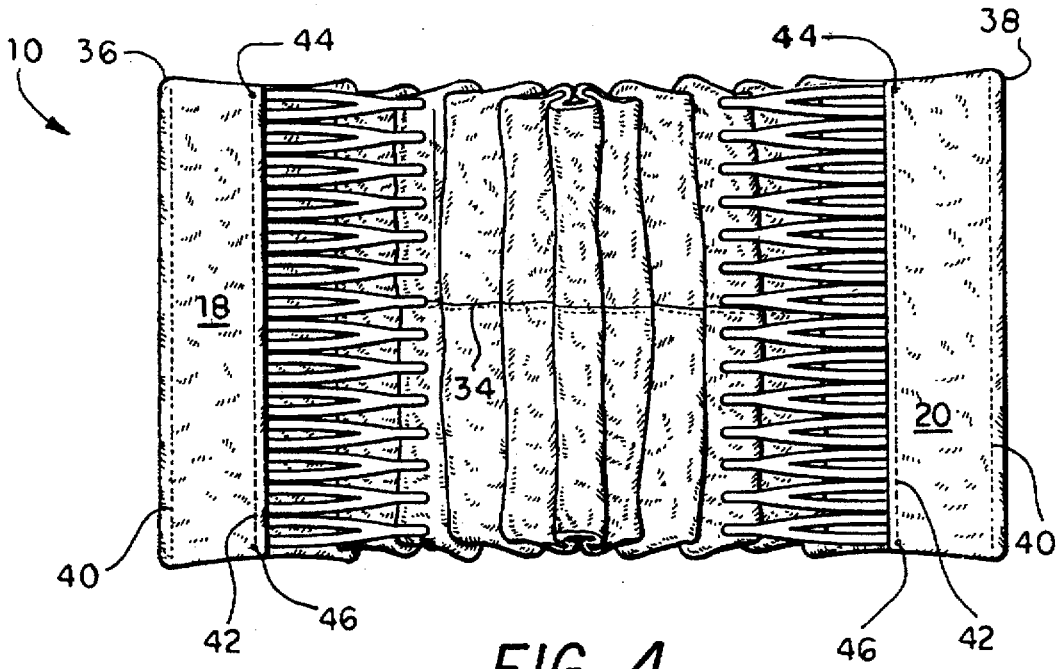
FIG. 4 is a rear elevational view of the present invention as seen in FIG. 1 showing each pocket containing a retaining comb.
Figure 5:
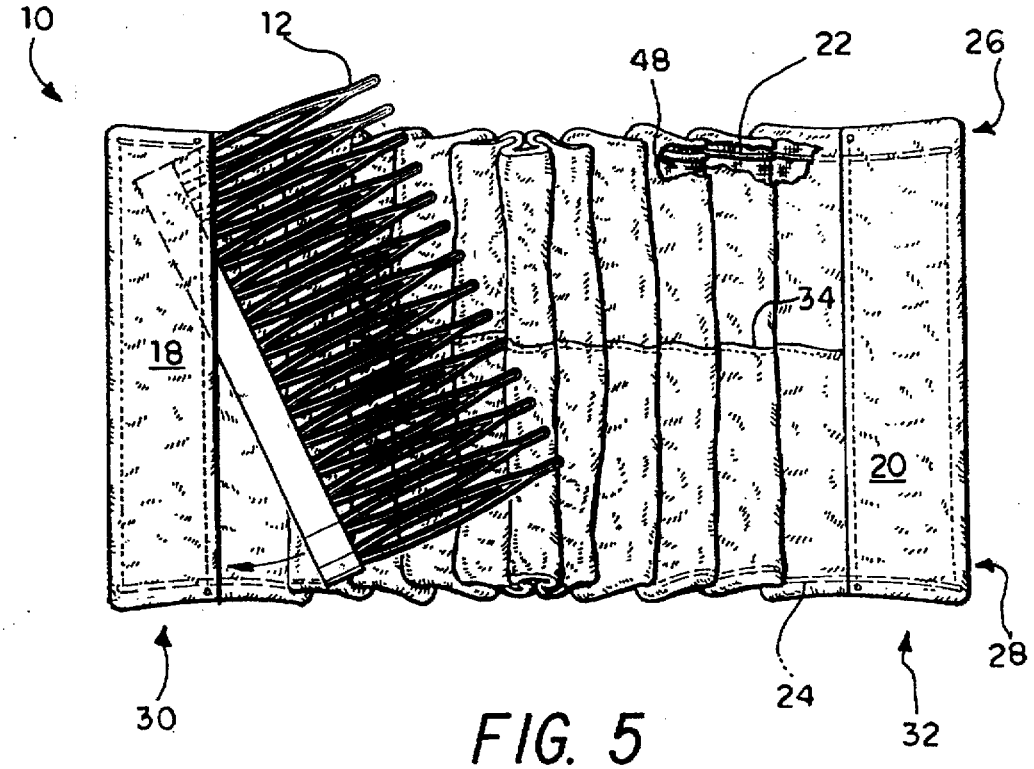
FIG. 5 is a rear elevational, partially cut-away view of the present invention as seen in FIG. 1 showing one pocket receiving a retaining comb.

As seen in FIGS. 1–6, the present invention is a hair fastener 10 intended to be used with retaining combs 12, 14 to retain hair in a style as desired by a wearer. The hair fastener 10 includes a fabric tube 16, a pocket 18, 20 disposed at each end 30, 32 of the tube 16, and an elastic band 22, 24 running along each edge 26, 28 of the tube 16.

Tube 16 is formed of a strip of fabric 16 and ½ inches long by 7 and ¼ inches wide. Tube 16 is folded over and stitched along its edges to form a seam 34 which serves to form a tubular passage 48 within the fabric strip. The tube 16 is then turned inside out such that the seam 34 is right-side out. The ends 30, 32 of the tube 16 are then turned in approximately ¼ of an inch. Once turned in, an elastic band 22, 24 which is 7 inches long by ¼ of an inch wide is inserted into the tubular passage 48 along the top and bottom edges 26, 28 of the fabric tube 16.

The ends of each elastic band 22, 24 are secured to each end 30, 32 of the fabric tube 16 such that elastic band 22 runs along the length of the fabric tube 16 at the top edge 26 and elastic band 24 runs along the length of the fabric tube 16 at the bottom edge 28. The bands 22, 24 are secured to the fabric tube 16 by an inner row of stitching 40. The inner row of stitching 40 not only holds the elastic bands 22, 24 to the fabric tube 16 but also encloses each end 30, 32 of the fabric tube 16.

At this point in construction, the seam 34 should be centrally located between the top and bottom edges 26, 28 of the fabric tube 16. Making sure each elastic band 22, 24 is at the top and bottom edge 26, 28, an outer row of stitching 42 is now made into the body of the fabric tube 16 approximately ¾ of an inch down from each end 30, 32. This outer row of stitching 42 secures each elastic band 22, 24 to the fabric tube 16, as well as serves as a guide in which to make the pockets 18, 20.

Pockets 18, 20 are now formed by making a fold 36, 38 at each end 30, 32 proximate to the outer row of stitching 42. Each fold 36, 38 should be made toward seam 34. Making sure that there will be enough room to slip the retaining combs 12, 14 into their respective pockets 18, 20 while not allowing the retaining combs 12, 14 to fall out, a top and bottom bar tack 44, 46 is made at top and bottom edges 26, 28 at each end 30, 32 of the fabric tube 16. Bar tacks 44, 46 should be made through each elastic band 24 in order to aid in securely holding the elastic bands 22, 24 in place. Retaining combs 12, 14 are now inserted into their respective pockets 18, 20 such that approximately half of each retaining comb 18, 20 is exposed. The fabric can be any solid or print comprising a recommended content of either a 100% polyester or a 65% polyester/35% cotton blend. Each elastic band 22, 24 can be that commonly known in the art, as for example, p/n 6726 ¼" by Providence Braid Co.

Advantageously, the wearer may easily insert into and remove from each of the pockets 18, 20 a retaining comb 12, 14. Due to the pockets 18, 20, approximately half of the retaining comb 12, 14 is concealed within each pocket 18, 20. As such, the wearer need not have as much hair placed through the retaining combs 12, 14 for the hair fastener 10 to function properly when compared to the amount of hair a fully exposed retaining comb requires.

The pockets 18, 20 in combination with retaining combs 12, 14 and the elastic bands 22, 24 of the hair fastener 10 permit the wearer to securely and attractively maintain the desired hair style without breaking or damaging the hair. In addition, the pocket design in conjunction with the elastic bands 22, 24 disposed within the fabric tube 16 creates a hairband with superior gripping properties due to the compression forces placed onto the hair. The elastic bands 22, 24 not only lock the retaining combs 12, 14 into place, but they also provide an ornamental effect to the fabric tube 16, which is itself ornamental. Furthermore, the materials used to construct the hair fastener 10 permit the wearer the ability to wash the article of clothing whenever convenient, without concern of damaging the retaining combs 12, 14 because they may be removed prior to washing.

To use the hair fastener 10 to pull hair back, as shown in FIG. 1, the wearer slides one retaining comb 12 flat against the scalp until it is secure on one side of their head. The wearer then holds onto the loose retaining comb 14 and stretches the hair fastener 10 across their head, sliding the retaining comb 14 flat against the scalp until it is secure on the other side. The wearer can position the hair fastener 10 either on the top, bottom, or crown of the head once the wearer has styled their hair as desired. The wearer may alternatively decide to give the hair fastener 10 a fuller look by twisting the loose retaining comb 14 one full turn before sliding it across their head and anchoring it into place.

Figure 6:
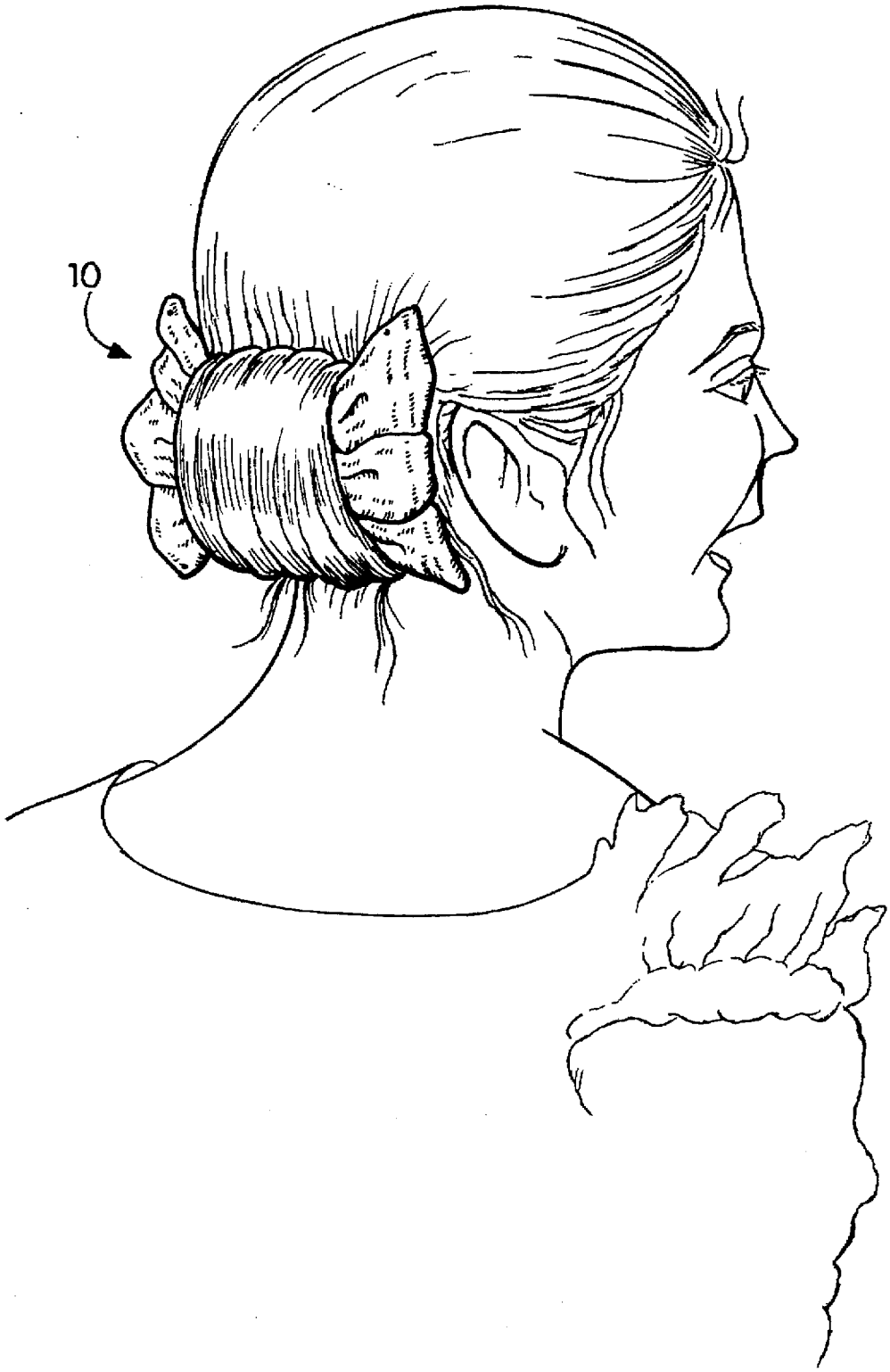
FIG. 6 is an environmental, perspective view of a hair fastener embodying the present invention adorned by a wearer in a bun position.

To use the hair fastener 10 to form a bun, as shown in FIG. 6, the wearer pulls their hair back, as described above, while positioning the hair fastener 10 in a relatively low position on their head, proximate to the neck. The wearer then twists their hair, bringing it over the hair fastener 10 and tucking it in under the hair fastener 10. This is continued until all the hair is in a bun.

It is to be understood that the present invention is not limited to the embodiment described above, but encompasses any and all embodiments within the scope of the following claims.

I claim:

1. A ornamental device for releasably capturing retaining combs, said ornamental device comprising:

a fabric tube having a first end, an opposing second end, a front, an opposite back, a top edge, and a bottom edge;

a first pocket proximate said first end;

a second pocket proximate said second end, whereby said first and second pockets may releasably capture the retaining combs; and a first elastic band disposed within said fabric tube, said first elastic band secured to said first end and said second end.

2. The ornamental device as defined in claim 1, further comprising a second elastic band disposed within said fabric tube, said second elastic band secured to said first end and said second end.

3. The ornamental device as defined in claim 2, wherein said first elastic band is proximate to said top edge.

4. The ornamental device as defined in claim 3, wherein said second elastic band is proximate to said bottom edge.

5. The ornamental device as defined in claim 4, wherein said first and second ends each have an inner and outer row of stitching running from said top edge to said bottom edge, said inner row enclosing said fabric tube and capturing said first and second elastic bands to said fabric tube, said outer row securing said first and second elastic bands to said fabric tube.

6. The ornamental device as defined in claim 1, wherein said first pocket is defined by a first fold in said first end, said first fold secured to said back.

7. The ornamental device as defined in claim 6, wherein said second pocket is defined by a second fold in said second end, said second fold secured to said back.

8. The ornamental device as defined in claim 7, wherein said first and second folds are each about three-fourths of an inch long.

9. The ornamental device as defined in claim 7, wherein said fabric tube has a seam on said back, said seam running from said first end to said second end.

10. The ornamental device as defined in claim 7, wherein said first and second folds are each secured to said back by a top and a bottom bar tack.

11. A hair fastener for retaining hair in a style as desired by a wearer comprising:

a fabric tube having a first end, an opposing second end, a front, an opposite back, a top edge, and a bottom edge;

a first pocket proximate said first end;

a second pocket proximate said second end;

a first comb disposed within said first pocket;

a second comb disposed within said second pocket, whereby said first and second pockets releasably capture said first and second combs for securing said hair fastener to the hair in the desired hair style; and a first elastic band disposed within said fabric tube, said first elastic band secured to said first end and said second end.

12. The hair fastener as defined in claim 11, further comprising a second elastic band disposed with said fabric tube, said second elastic band secured to said first end and said second end, wherein said first elastic band is proximate to said top edge, and said second elastic band is proximate to said bottom edge.

13. The hair fastener as defined in claim 11, wherein said first pocket is defined by a first fold in said first end, said first fold secured to said back.

14. The hair fastener as defined in claim 13, wherein said second pocket is defined by a second fold in said second end, said second fold secured to said back.

15. The hair fastener as defined in claim 14, wherein said first pocket encloses about half of said first comb, and said second pocket encloses about half of said second comb.

16. The hair fastener as defined in claim 15, further comprising a first elastic band disposed within said fabric tube, said first elastic band secured to said first end and said second end, and a second elastic band disposed within said fabric tube, said second elastic band secured to said first end and said second end, wherein said first elastic band is proximate to said top edge and said second elastic band is proximate to said bottom edge.

17. The hair fastener as defined in claim 16, wherein said fabric tube has a seam on said back, said seam running from said first end to said second end, and said first and second ends each have an inner and outer row of stitching running from said top edge to said bottom edge, said inner row enclosing said fabric tube and capturing said first and second elastic bands to said fabric tube, said outer row securing said first and second elastic bands to said fabric tube.

18. The hair fastener as defined in claim 17, wherein said first and second folds are each secured to said back by a top and a bottom bar tack for releasably capturing said first comb within said first pocket and said second comb within said second pocket, said top and bottom bar tacks also securing said first and second elastic bands to said fabric tube.

* * * * *